US005706736A

United States Patent [19]

Thorsen

[11] Patent Number: 5,706,736

[45] Date of Patent: Jan. 13, 1998

[54] POLAR CRANE AND RELATED METHOD

[75] Inventor: George E. Thorsen, Wauwatosa, Wis.

[73] Assignee: Harnischfeger Corporation, Brookfield, Wis.

[21] Appl. No.: 584,223

[22] Filed: Jan. 11, 1996

[51] Int. Cl.[6] ..... B61F 13/00

[52] U.S. Cl. ..... 105/163.2; 212/226; 212/318

[58] Field of Search ..... 105/163.1, 163.2; 212/226, 318

[56] References Cited

U.S. PATENT DOCUMENTS

| | | | |
|---|---|---|---|
| 267,149 | 11/1882 | Capen | 150/163.1 |
| 3,095,829 | 7/1963 | Dehn | 105/163.2 |
| 3,246,775 | 4/1966 | Connelly et al. | 105/163.2 |
| 3,703,016 | 11/1972 | Schramm et al. | 105/163.1 |
| 3,887,080 | 6/1975 | Wilson | 212/318 |
| 4,161,144 | 7/1979 | Raugulis | 105/163.1 |
| 5,216,957 | 6/1993 | Thorsen | 105/163.2 |
| 5,492,067 | 2/1996 | Anderson | 105/163.2 |

FOREIGN PATENT DOCUMENTS

| | | | |
|---|---|---|---|
| 849351 | 8/1970 | Canada | 212/226 |
| 181865 | 12/1962 | Sweden | 212/226 |

*Primary Examiner*—S. Joseph Morano
*Attorney, Agent, or Firm*—Jansson & Shupe, Ltd.

[57] ABSTRACT

Disclosed is a polar crane supported by a rail and having a bridge and a bridge-supporting end truck at each end of the bridge. Each end truck has, for either direction of revolving bridge motion, a leading wheel contacting the rail. In the improvement, the leading wheel of each end truck has a single flange and the flange is inward of the rail. Skewed crane "lock-up" is thereby substantially prevented. A related method for modifying a polar crane includes raising the first end truck away from the rail, removing a two-flange wheel (the leading wheel) from the first end truck and installing a one-flange wheel in place thereof.

8 Claims, 6 Drawing Sheets

POLAR CRANE AND RELATED METHOD

FIELD OF THE INVENTION

This invention relates to material-handling machines and, more particularly, to machines of the traversing-hoist, overhead type commonly known as cranes.

BACKGROUND OF THE INVENTION

Most of those types of material-handling machines known as cranes are configured to travel along parallel spaced rails. There are two primary types of such cranes, namely, overhead travelling cranes and portal cranes.

An overhead travelling crane (OTC) has two spaced parallel bridge girders which together form the "bridge." Such girders are supported at each end by rail-riding end trucks. As the name suggests, an OTC including its end trucks are supported on a runway having parallel rails that are both at the same elevation above a "working floor." The end trucks ride along such rails.

The crane has a trolley which moves along another set of rails mounted on the bridge girders. Most OTCs operate on indoor runways or on outdoor runways adjacent to manufacturing facilities or the like. Such cranes move machinery and steel in fabrication shops, handle ladles of hot metal in foundries and perform other similar tasks.

Portal cranes (sometimes called gantry cranes) are often used outdoors and the parallel spaced rails are at or near ground level. A portal crane is shaped generally like an inverted "U" and the elevated horizontal span between the support legs is the bridge. Like an OTC, a portal crane has a trolley that moves along the bridge transversely to the direction of crane travel. (A species of portal crane, a "half-portal" or "halfgantry," is shaped like an inverted "L," has one end of the bridge supported by an elevated rail and the sole leg at the other bridge end is supported by another rail at, e.g., ground level.

While OTC and portal cranes are very common, they are by no means the only types of material-handling cranes. Another type, which is believed to have had its origin in the nuclear power industry and which is understood to be relatively rare, is called a polar crane.

In overall configuration, a polar crane closely resembles a more-conventional "parallel-rail-riding" OTC in that a polar crane has a two-girder bridge (or an analogous structure) and a pair of end trucks, one end truck at each pair of girder ends, for supporting the bridge. Rails are mounted on the bridge for supporting a trolley. Rather than travelling on two parallel rails, a polar crane moves on a single rail which defines a circle. That is, each of the two end trucks rides on the same rail.

(A "hybrid" OTC runs on parallel rails and has a small polar crane atop the bridge. This arrangement permits rotational as well as linear movement of the suspended load. For certain types of loads, rotational load movement might be very difficult to perform in any other way.)

In normal operation and with normal loading, the bridge longitudinal centerline of a polar crane is generally coincident with a diameter of the circle defined by the rail. And, of course, the trolley moves diametrically with respect to such circle.

A fact of crane operation is that the crane is often "eccentrically loaded." The load is not centered between the end trucks of an eccentrically-loaded crane. That is, the trolley supporting such load—e.g., a very heavy load—is closer (perhaps much closer) to one end truck than to the other.

When the end trucks are powered by independent electric motors (i.e., by one or more motors at each end truck), the motor(s) powering a particular end truck will respond only to the load imposed upon such motor(s) and not to the load imposed upon the motor(s) of the other end truck. When the end trucks are disparately loaded, that end truck at the lightly-loaded end of the bridge is likely to accelerate more rapidly than the end truck at the heavily-loaded end of the bridge. Crane "skewing" results.

Crane end trucks are equipped with double-flanged wheels rolling atop the rail(s). The presence of inward and outward flanges (one flange on either side of the rail) helps prevent the crane from leaving the rail(s), especially during skewing. On the other hand, crane skewing can force wheel flanges against rails and halt crane movement, perhaps abruptly.

When a polar crane is eccentrically loaded, its lightly-loaded end truck tends to "get ahead of" the heavily-loaded end truck in terms of both rate of acceleration and distance travelled per unit time. As a consequence, the bridge longitudinal centerline becomes coincident with a chord of the rail circle rather than with a circle diameter.

When that occurs, the inside flange(s) of the leading wheel(s) on the lightly-loaded truck contact the inside edge of the rail. At best, rail and flange abrasion and scuffing result and high thrust loads are imposed upon axle bearings. And in an extreme case, the flange(s) "bite into" the rail and prevent further crane movement, the lightly-loaded truck distorts and axles on such truck may break. Stated in other words, if eccentric loading of a polar crane manifests itself in flange/rail abrasion, it does so at least at the "interface" of the rail and the inside flange(s) of the leading wheel(s) on the lightly-loaded truck.

Sometimes a skewed crane "locks up" so tightly on the rail that special equipment must be employed to free it. And, of course, the crane is out of service and not available for load moving until it is freed.

There are ways, sometimes not possible or practical in particular installations, to synchronize the driving characteristics of the motor(s) at the two end trucks and make such motors "dedicated." A connecting mechanical line shaft is one way—but consider the difficulty of using such a line shaft on a crane having a bridge span of in excess of 100 feet, about 30 meters. A line shaft of that length and sized by conventional engineering techniques would, over such length, twist or "torque up" to a degree that it would or may be ineffective as a motor synchronizing device.

Another way to synchronize motors is disclosed in application Ser. No. 08/287,514, now U.S. Pat. No. 5,492,067 (Anderson) which is assigned to the same assignee as the invention of this application. Yet another way is disclosed in U.S. Pat. No. 3,703,016 (Schramm et al.) and uses rheostat imbalance to create a drive-correcting signal. If load eccentricity (and resulting skewing) become too great, the control disables the drive. In effect, the above-noted prior art approaches convert independent motors into dedicated or synchronized motors.

While these prior art approaches have been generally satisfactory for their intended purposes, none have been applied to a polar crane, insofar as is known. And they seem impractical for use with an infrequently-used (but critical) polar crane of the type found in nuclear power stations (NPS). An exemplary NPS polar crane has a bridge span of over 100 feet (about 30 meters), uses two horsepower motors on each end truck and has a maximum end truck running speed along the rail of about 50 feet/minute (about 15 meters/minute). Such exemplary crane has a trolley weighing about 150 short tons (about 135 metric tons) and having a lifting capacity of about 125 short tons (about 110 metric tons).

An improved polar crane and related method which substantially prevents flange/rail engagement that causes skewing-related crane "lock-up," which are suitable for use with a polar crane having independent end truck drive motors and which retain motor independence would be an important advance in the art.

OBJECTS OF THE INVENTION

It is an object of the invention to provide an improved polar crane and related method overcoming some of the problems and shortcomings of the prior art.

Another object of the invention is to provide an improved polar crane and related method which retain end truck drive motor independence.

Another object of the invention is to provide an improved polar crane and related method which reduce the opportunity for crane lock-up due to skewing.

Still another object of the invention is to provide an improved polar crane and related method which reduce wear and tear on crane end trucks, axles and bearings.

Another object of the invention is to provide an improved polar crane and related method which avoids the use of motor-synchronizing line shafts and electronic controls.

Yet another object of the invention is to provide an improved polar crane and related method which are suitable for use in extreme cases of crane eccentric loading. How these and other objects are accomplished will become apparent from the following descriptions and from the drawings.

SUMMARY OF THE INVENTION

Understanding of this summary and of the detailed description will be aided by first referring to the definitions at the end of such summary. The invention involves a polar crane supported by a rail having an inward edge. The crane has a bridge and a bridge-supporting end truck at each bridge end. Each end truck has, for either direction of revolving bridge motion, a leading wheel contacting the rail. In the improvement, the leading wheel of each end truck has but a single flange and that flange is inward of the rail.

In a more specific description of the invention, the weight supported by the first end truck is at least twice the weight supported by the second end truck and perhaps even four or five times the weight supported by such second end truck. For either direction of revolving bridge motion, each end truck has a trailing wheel atop the rail. The bridge longitudinal centerline is along a chord of the rail circle, the flange of the leading wheel of the first end truck is the sole flange for that wheel. Such flange is inward of the rail inward edge.

Polar crane end trucks may (and often do) have more than two wheels. Such an end truck has first and second leading wheels forward of the centerline. Each of the second leading wheels has a single flange and each such flange is inward of the rail.

In a hybrid OTC of the type described in the Background, the smaller polar crane is atop a rotating trolley and the rail is a circular rail supported on the trolley. The bridge is supported on linear end trucks which travel on rails that are generally linear and spaced apart. The smaller polar crane has two end trucks, the leading wheels of each of which have but a single flange inward of the circular rail.

Another aspect of the invention involves a method for making a polar crane for handling loads eccentrically-imposed on such crane. The method includes the steps of providing an end truck frame having an inward side, an outward side and a first wheel mounting position and mounting a first wheel at the first wheel mounting position. To help prevent crane lockup, the first wheel has a flange only toward the inward side.

In crane configurations having more than one wheel which is a leading wheel for a particular direction of travel, the method includes mounting a second wheel at a second wheel mounting position. Such second wheel also has a flange only toward the inward side.

For end truck configurations having, say, six wheel mounting positions, the method includes mounting third and fourth wheels at the third and fourth mounting positions, respectively. These third and fourth wheels will likely not be required to have a single flange to help avoid crane lockup. In other words, each of the third and fourth wheels has two flanges. On the other hand, when the bridge revolves in a direction such that the fifth and sixth wheels are leading wheels, such wheels may be required to have but a single flange to avoid crane lockup. In that instance, the method includes mounting fifth and sixth wheels at the fifth and sixth wheel mounting positions, such fifth and sixth wheels each having a flange only toward the inward side.

Another aspect of the invention is useful in crane conversion or repair. One may need to modify a polar crane supported by a rail and having a bridge and first and second end trucks at respective ends of the bridge. Prior to modification, each end truck has a two-flange wheel contacting the rail. The method includes the steps of raising the first end truck away from the rail, removing the two-flange wheel from the first end truck and installing a one-flange wheel in place of the two-flange wheel.

As will be appreciated from the preceding discussion of the invention, that two-flange wheel which is replaced by a one-flange wheel is a wheel which has its single flange inward of the rail and which is a leading wheel for a particular direction of crane rotation. When an end truck has more than two wheels (as is usually the case), the leading wheel is that wheel most distant from the bridge centerline.

Unless the polar crane revolves in only one direction, e.g., counterclockwise (and that would be a very unusual situation), the method also includes the steps of raising the second end truck away from the rail and removing the two-flange wheel from the second end truck. Thereupon, a one-flange wheel is installed on the second end truck in place of the leading two-flange wheel removed therefrom. This newly-installed one-flange wheel also has its sole flange inward of the crane rail.

As used in this specification, "inward" means toward the center of the circle defined by such rail. And such circle is referred to herein as the "rail circle". A leading wheel of an end truck is a wheel which, to a viewer standing on that end truck at the bridge longitudinal centerline and looking in the direction of travel of such end truck, is positioned forwardly of such centerline. A trailing wheel is positioned rearwardly of such centerline to the same viewer looking in the same direction.

Other details of the invention are set forth in the following detailed description and in the drawings.

DETAILED DESCRIPTION OF PREFERRED EMBODIMENTS

Figure 1:
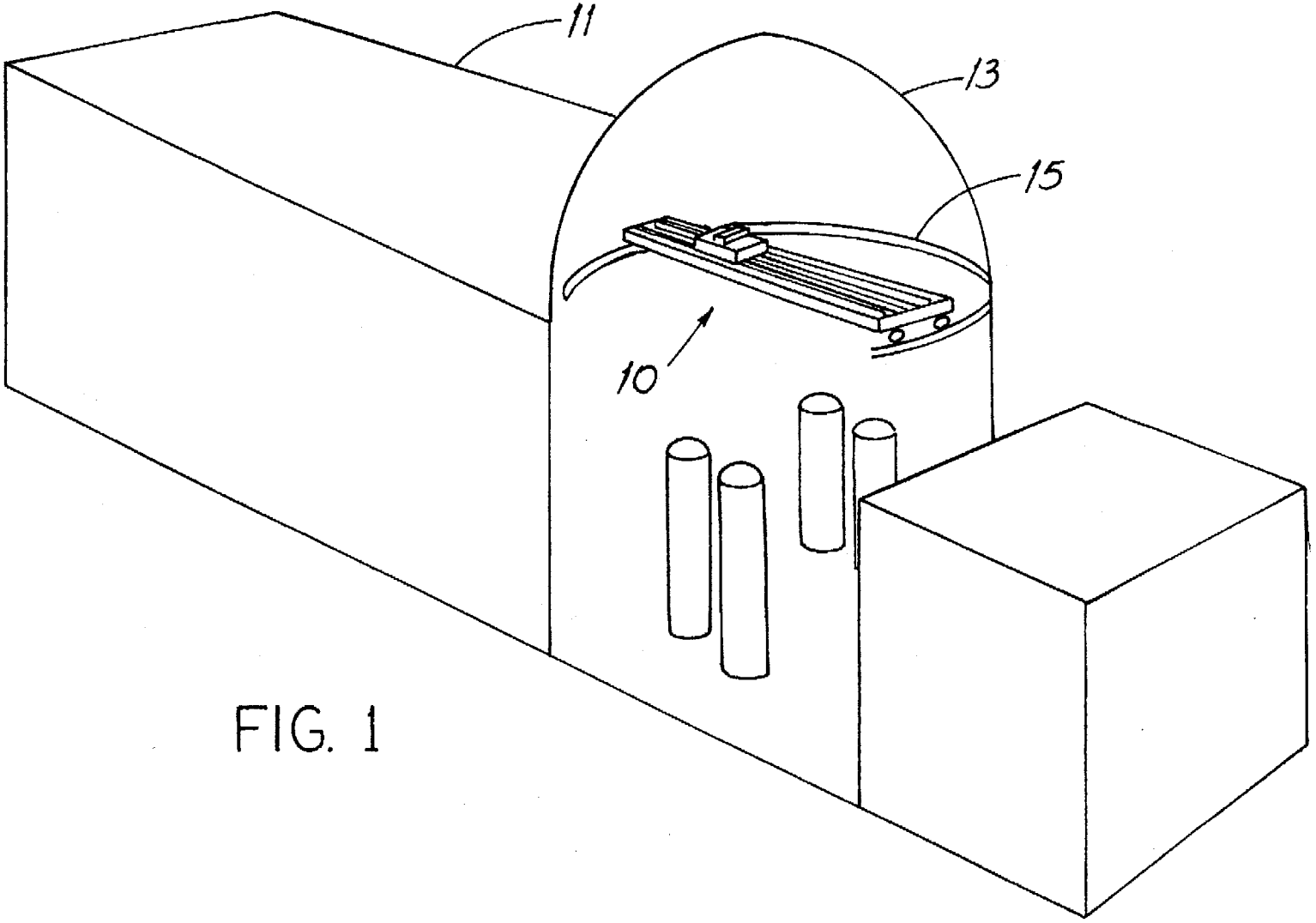
FIG. 1 is a simplified perspective view showing a nuclear generating station and a typical application for the new polar crane. Parts are broken away.
Figure 2:
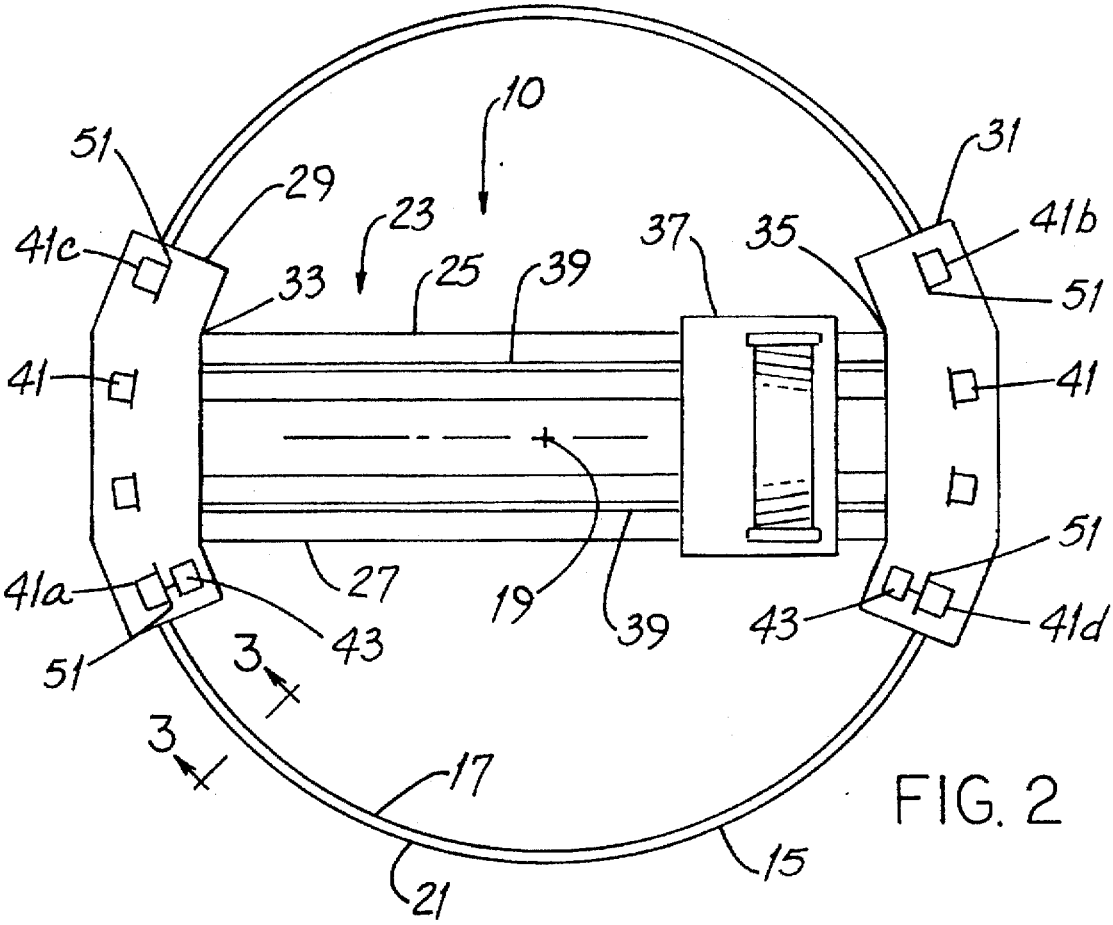
FIG. 2 is a top plan view of the polar crane and the crane-supporting rail shown in FIG. 1.
Figure 3:
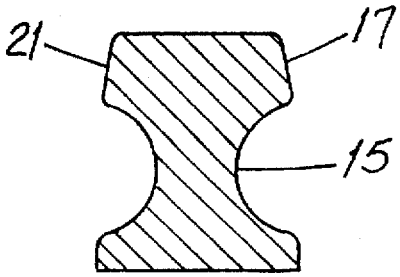
FIG. 3 is a sectional elevation view of the rail shown in FIG. 2 taken along the viewing plane 3—3 thereof.

Before describing details of the polar crane 10 and related method, it will be helpful to have a general understanding of how such a crane 10 operates, where it is used and why the invention represents a distinct advance in the art. Referring to FIGS. 1, 2 and 3, an exemplary nuclear generating plant 11 includes a dome-shaped structure 13 in which is mounted a single rail 15 having an inward edge 17, i.e., an edge toward the circle center 19, and an outward edge 21. The rail 15 defines a circle in a horizontal plane.

Mounted atop the rail 15 is a polar crane 10 having a bridge 23 (formed by two parallel bridge girders 25, 27) supported by two end trucks 29, 31, one at each bridge end 33, 35, respectively. Mounted atop the girders 25, 27 is a load-handling trolley 37 which moves along parallel rails 39.

Figure 4:
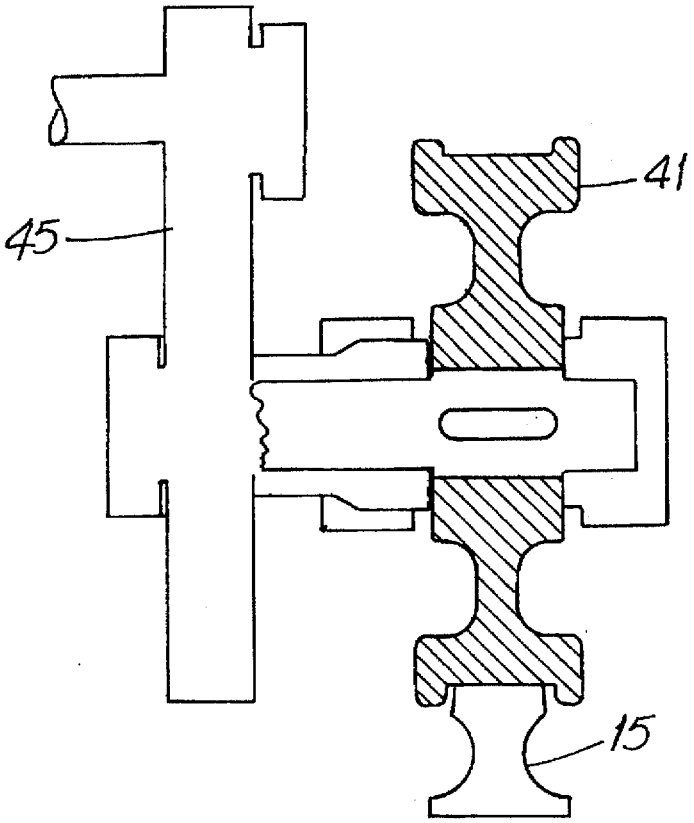
FIG. 4 PRIOR ART
FIG. 4 is a representative elevation view, partly in section and with parts broken away, showing a wheel-supporting rail and a prior art driven wheel used on earlier polar cranes prior to the invention.
Figure 5:
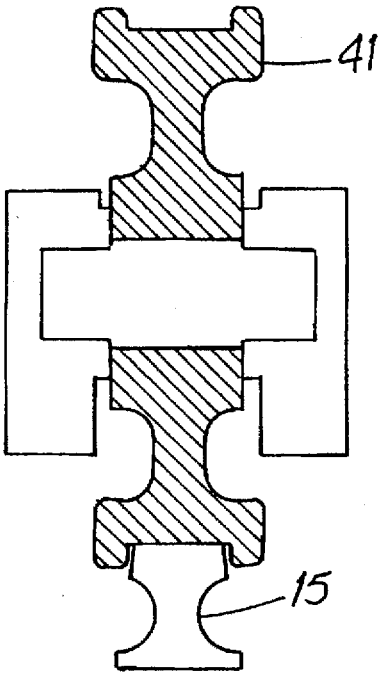
FIG. 5 PRIOR ART
FIG. 5 is a representative elevation view, partly in section and with parts broken away, showing a wheel-supporting rail and a prior art idler wheel used on earlier polar cranes prior to the invention.

Each end truck 29, 31 has several wheels on the rail 15 and for each end truck 29, 31, a wheel 41 is independently powered by a motor 43, e.g., an AC squirrel cage motor of a few horsepower. Wheels 41 which are not powered by a motor 43 are referred to as idler wheels 41. FIG. 4 shows a wheel 41 powered by a motor through gearing 45 and FIG. 5 shows an idler wheel 41.

It is to be appreciated that with independently-driven wheels 41, each motor 43 responds solely to the load imposed upon it. There is no "speed matching" control or motor-coupling line shaft.

It is also to be appreciated that motor speed is a function of motor load. This principle is important to an understanding of the invention.

DESCRIPTION OF THE PROBLEM SOLVED BY THE INVENTION

Figure 6:
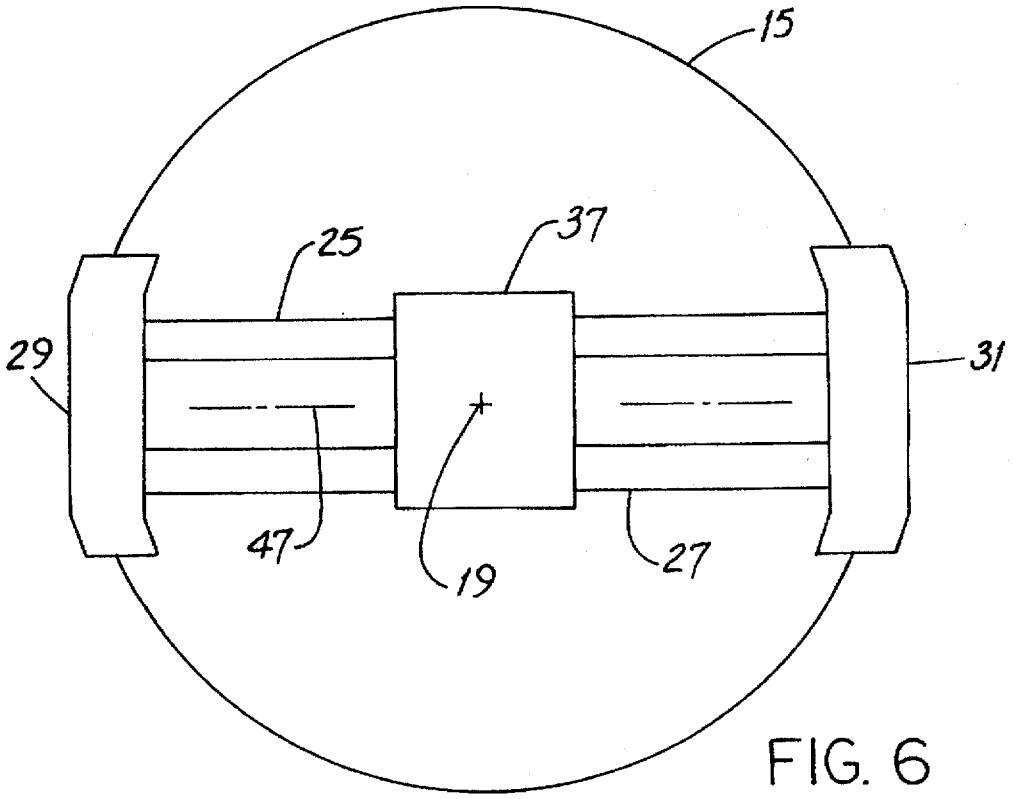
FIG. 6 is a simplified top plan view of the polar crane and the crane-supporting rail shown in FIG. 2 but with the trolley generally centered between the crane end trucks.

If the trolley 37 is substantially centered between the end trucks 29, 31 as represented in FIG. 6, such end trucks 29, 31 and the motors 43 powering wheels 41 are substantially equally loaded. For either direction of crane rotation, the end trucks 29, 31 travel at substantially equal speeds (typically 50 feet per minute or less) and the crane centerline 47 remains substantially coincident with the center 19 of the circle defined by the rail 15.

Figure 7:
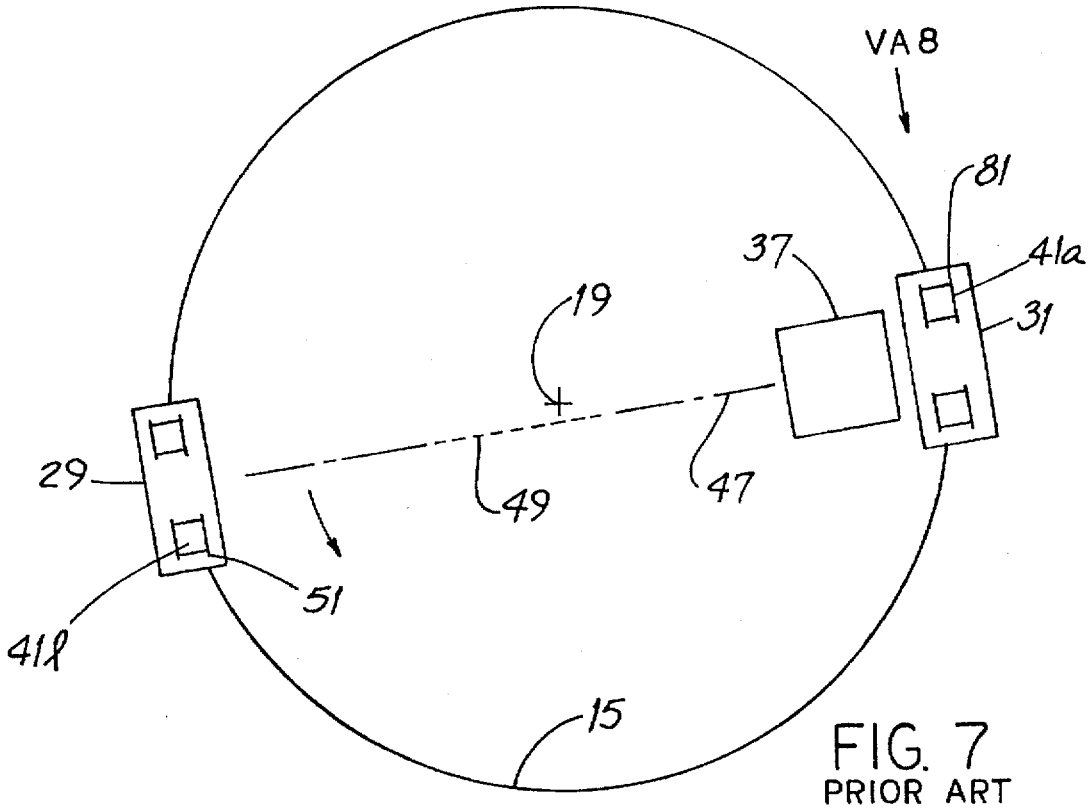
FIG. 7 PRIOR ART
FIG. 7 is a simplified top plan view representation of a prior art polar crane showing the effect of unequal loading of the end trucks and resulting crane skewing.

On the other hand, if the trolley 37 is much nearer one end truck 31 than the other end truck 29 as shown in FIG. 7, the more-lightly-loaded end truck 29 moves more rapidly along the rail 15 and the centerline 47 of the crane 10 becomes out of registry with the center 19 of the circle. The centerline 47 becomes coincident with a chord 49 of the circle rather than with a diameter thereof. The crane 10 is therefore said to be "skewed."

Figure 8:
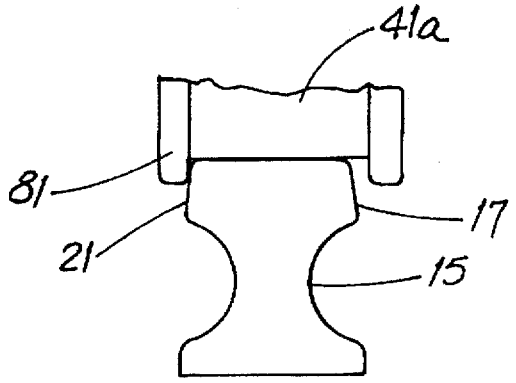
FIG. 8 PRIOR ART
FIG. 8 is an elevation view of prior art, with parts broken away, showing "jamming" contact of a wheel flange with the rail when the crane is skewed. The view of FIG. 8 is taken generally along the viewing axis VA8 of FIG. 7.

When the crane 10 is skewed as shown in FIG. 7, the outside flange 81 of the leading wheel 41*a* become jammed against the outward edge 21 of the rail 15 as shown in FIG. 8. At the least, wheel flange and rail damage result. And further movement of the lightly-loaded end truck 29 aggravates the jammed condition. In a more aggravated case, such flange 81 is jammed so tightly against the outward edge 21 that the crane 10 cannot be returned to service except by bringing in heavy equipment and jacking up the end truck 31. (Even though the inward flange 51 of the leading wheel 411 of the lightly-loaded end truck 29 may contact and scuff along the inward edge 17 of the rail 15, such flange 51 is unlikely to jam against such inward edge 17 to the extent that further movement of end truck 29 is prevented.)

The magnitude of the problem is better appreciated by understanding that the crane 10 itself may weight 250 tons and may have a 125 ton load suspended from the trolley 37. And as in FIG. 7, when the trolley 37 is toward one end truck, e.g., truck 31, the weight supported by the first end truck 29 may be at least twice the weight supported by the second end truck and perhaps even four or five times the weight supported by such second end truck 29.

DESCRIPTION OF THE INVENTION

Referring further to FIG. 2, details of the inventive polar crane 10 and method will now be set forth. For either direction of revolving bridge motion, one wheel 41 on each end truck 29, 31 is a leading wheel 41 and another is a trailing wheel 41. For example, if the crane 10 is revolving counterclockwise, the leading wheel on the end truck 29 is wheel 41*a* and the leading wheel on the end truck 31 is wheel 41*b*. The trailing wheels on such end trucks 29, 31 are wheels 41*c* and 41*d*, respectively. If the crane 10 is revolving clockwise, the leading wheel on the end truck 29 is wheel 41*c*. In the improvement, the leading wheel of each end truck 29, 31 has but a single flange 51 and that flange 51 is inward of the rail 15.

Figure 9:
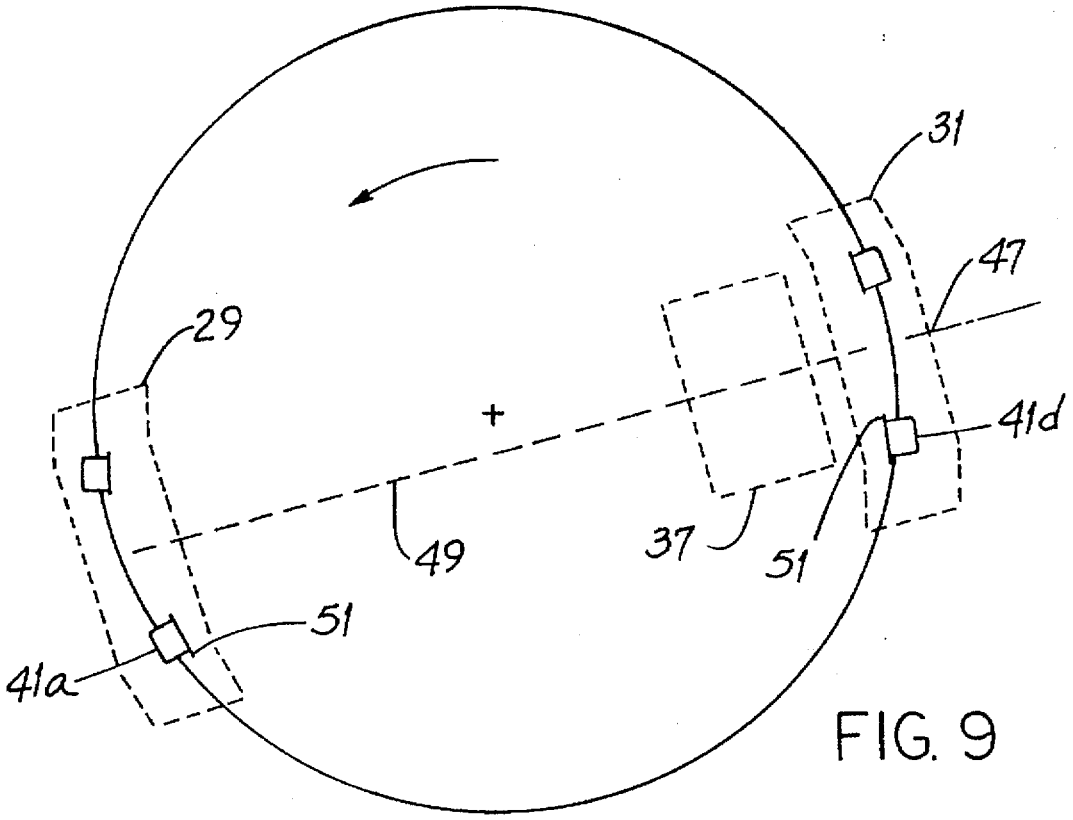
FIG. 9 is a simplified top plan view representation of an improved polar crane showing unequal loading of the end trucks, resulting crane skewing and a new wheel configuration preventing substantial flange-rail "jamming" when the crane is skewed.

When the crane 10 is configured with leading wheel(s), e.g., wheels 41*a*, 41*b*, each having a single inward flange 51 and if the crane 10 is eccentrically loaded as represented in FIG. 9, the crane 10 and its wheels 41 may assume the positions shown. The crane longitudinal centerline 47 is along a chord 49 of the rail circle, the flange 51 of the leading wheel 41*a* of the first end truck 29 may contact the rail inward edge 17 and the trailing wheel 41*d* of the second end truck 31 has an inward flange 51 spaced slightly away from the inward edge 17 of the rail 15.

Figure 10:
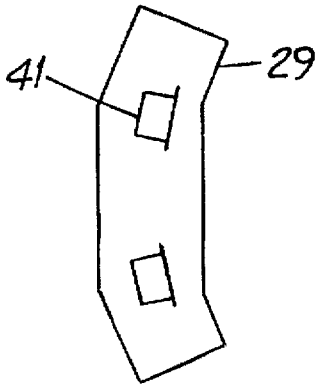
FIG. 10 is a simplified top plan view of a two-wheel end truck useful with the new polar crane.
Figure 11:
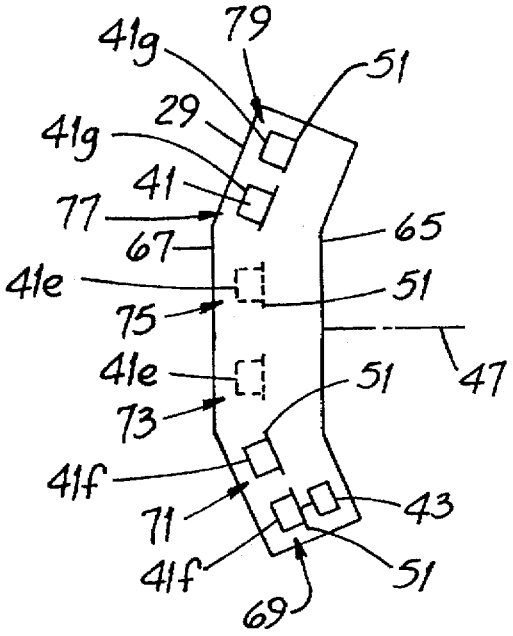
FIG. 11 is a simplified top plan view of a six-wheel end truck useful with the new polar crane. Certain wheels are shown in dashed outline.

Referring also to FIGS. 10 and 11, polar crane end trucks may have two wheels 41 or more than two wheels 41. In the exemplary end truck 29 of FIG. 11, such end truck 29 has first and second leading wheels 41*e*, 41*f*, respectively, forward (assuming counterclockwise crane motion) of the centerline 47. Each of the second leading wheels 41*f* also has a single flange 51 and each such flange 51 is also inward of the rail 15.

Figure 12:
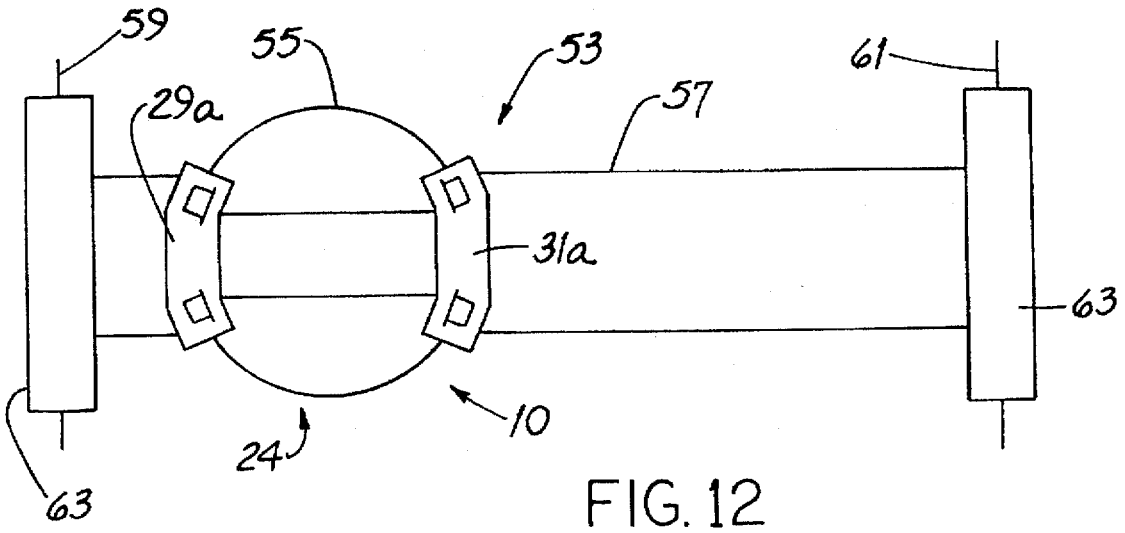
FIG. 12 is a simplified top plan view of a hybrid overhead travelling crane having a main bridge that travels along parallel rails and a smaller polar crane mounted for revolving movement on a circular rail atop the main bridge.

In a hybrid crane 53 of the type described in the Background and shown in FIG. 12, the smaller polar crane 10 has a rotating trolley 24 and the rail 55 is a circular rail supported on the trolley 24. The bridge 57 is supported on linear end trucks 63 which travel on second and third rails 59, 61 that are generally linear and spaced apart. The end trucks 29*a*, 31*a* ridge atop the circular rail 55. Since eccentric loading and consequent wheel flange lockup can be a problem even in a smaller polar crane 10 such as that illustrated in FIG. 12, the end trucks 29*a*, 31*a* have wheel flange arrangements as described above.

Referring particularly to FIG. 11, another aspect of the invention involves a method for making a polar crane 10 for handling loads eccentrically-imposed on such crane 10. The method includes the steps of providing an end truck 29 having an inward side 65, an outward side 67 and a first wheel mounting position 69 and mounting a first wheel 41*f* at the first wheel mounting position 69. To help prevent crane lockup, the first wheel 41*f* has a flange 51 only toward the inward side 65.

In crane configurations having more than one wheel which is a leading wheel for a particular direction of travel, the method includes mounting a second wheel 41*f* at a second wheel mounting position 71. Such second wheel 41*f* also has a flange 51 only toward the inward side 65.

For end truck configurations having, say, six wheel mounting positions 69, 71, 73, 75, 77, 79, the method includes mounting third and fourth wheels 41*e* at the third and fourth mounting positions 73, 75, respectively. Most preferably, the third and fourth wheels 41*e* will also have but a single flange to help avoid crane lockup. In other words, each of the third and fourth wheels 41*e* has one flange, i.e., an inward flange 51.

When the bridge 23 revolves in a direction such that the fifth and sixth wheels 41*g* are leading wheels, such wheels may be required to have but a single flange 51 to avoid crane lockup. In that instance, the method includes mounting fifth and sixth wheels 41*g* at the fifth and sixth wheel mounting positions 77, 79, respectively, such fifth and sixth wheels 41*g* each having a flange 51 only toward the inward side 65.

Another aspect of the invention is useful in crane conversion or repair. One may need to modify a polar crane supported by a rail 15 and having a bridge 23 and first and second end trucks 29, 31 at respective ends 33, 35 of the bridge 23. Prior to modification, each end truck 29, 31 has a two-flange wheel 41 contacting the rail 15 as shown in FIGS. 4 and 5. The method includes the steps of raising the first end truck 29 away from the rail 15, removing the two-flange wheel 41 from the first end truck 29 and installing a one-flange wheel 41*g* in place of the two-flange wheel 41.

As will be appreciated from the preceding discussion of the invention, that two-flange wheel 41 which is replaced by a one-flange wheel 41*g* is a wheel which is a leading wheel for a particular direction of crane rotation. Most typically, such leading wheel is that most distant from the crane centerline 41.

Unless the polar crane 10 revolves in only one direction, e.g., counterclockwise (and that would be a very unusual situation), the method also includes the steps of raising the second end truck 31 away from the rail 15 and removing the two-flange wheel 41 from the second end truck 31. Thereupon, a one-flange wheel 41*d* is installed on the second end truck 31 in place of the leading two-flange wheel removed therefrom. The newly-installed one-flange wheels 41 each have their sole flanges 51 inward of the crane rail 15. Most preferably, all two-flange wheels should be replaced by a wheel having but a single flange inward of the rail 15.

As used in this specification, "inward" means toward the center 19 of the circle defined by the rail 15. And such circle is referred to herein as the "rail circle." A leading wheel of an end truck is a wheel which, to a viewer standing on that end truck at the bridge longitudinal centerline and looking in the direction of travel of such end truck, is positioned forwardly of such centerline. A trailing wheel is positioned rearwardly of such centerline and is behind the same viewer looking in the same direction.

While the principles of the invention are shown and described in connection with specific embodiments, it is to be understood clearly that such embodiments are by way of example and are not limiting.

What is claimed:

1. In a polar crane supported by a rail and having a bridge and a pair of spaced-apart linear bridge girders and a bridge-supporting end truck at each end of the bridge girders, and wherein each end truck is circumferentially-spaced from the other end truck, each end truck includes first, second and third wheels supporting the weight of the girders on the rail, the improvement wherein:

the first wheel on each end truck is a leading wheel for a particular direction of revolving bridge motion on the rail;

each of the leading wheels has a single flange which is inward of the rail; and as to each end truck, the second wheel is between the first and third wheels and has two flanges.

2. The crane of claim 1 wherein:

the rail forms a circle;

the bridge has a longitudinal centerline; and the centerline is along a chord of the circle.

3. The crane of claim 1 wherein:

the bridge has a longitudinal centerline; and each of the second leading wheels is spaced from the centerline.

4. In a hybrid polar crane supported by a pair of linear, spaced-apart rails and having a bridge and a bridge-supporting end truck at each end of the bridge, the improvement wherein:

the bridge supports a rotating trolley on a circular rail;

the trolley includes two trolley end trucks, each trolley end truck is circumferentially-spaced from the other end truck, each trolley end truck is supported on the circular rail and has, for a particular direction of rotation of the trolley on the circular rail, a leading wheel and a second wheel contacting the circular rail;

the leading wheel of each trolley end truck has a single flange and the flange is inward of the circular rail; and the second wheel has two flanges.

5. A method for making a polar crane for handling loads eccentrically-imposed thereon and including the steps of:

providing a pair of end truck frames for attachment to a pair of linear girders, each frame having an inward side, an outward side and first, second and third wheel mounting positions;

mounting a first wheel at the first wheel mounting position, such first wheel having a flange only toward the inward side; and mounting a second wheel at the second wheel mounting position, such second wheel having two flanges.

6. The method of claim 5 including mounting a third wheel at the third wheel mounting position, such third wheel having at least one flange and the said at least one flange is toward the inward side.

7. The method of claim 6 wherein the frame has a fourth wheel mounting position and the method includes:

mounting a fourth wheel at the fourth mounting position, such fourth wheel having a flange only toward the inward side.

8. A method for making a polar crane for handling loads eccentrically-imposed thereon and including the steps of:

providing an end truck frame having an inward side, an outward side and first, second, third, fourth, fifth and sixth wheel mounting positions;

mounting first and second wheels at the first and second mounting positions, respectively, such first and second wheels each having a flange only toward the inward side;

mounting third and fourth wheels at the third and fourth mounting positions, respectively, each of the third and fourth wheels having two flanges; and mounting fifth and sixth wheels at the fifth and sixth wheel mounting positions, such fifth and sixth wheels each having a flange only toward the inward side.

* * * * *